US010716723B2

(12) United States Patent
Miller

(10) Patent No.: US 10,716,723 B2
(45) Date of Patent: Jul. 21, 2020

(54) BED HANDLE SUPPORT SYSTEM

(71) Applicant: Stander Inc., Logan, UT (US)

(72) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 288 days.

(21) Appl. No.: 15/801,069

(22) Filed: Nov. 1, 2017

(65) Prior Publication Data

US 2018/0116886 A1 May 3, 2018

Related U.S. Application Data

(60) Provisional application No. 62/416,529, filed on Nov. 2, 2016.

(51) Int. Cl.
*A61G 7/053* (2006.01)
*A61G 7/05* (2006.01)

(52) U.S. Cl.
CPC ..... *A61G 7/053* (2013.01); *A61G 7/0518* (2016.11); *A61G 7/0509* (2016.11); *A61G 7/0516* (2016.11)

(58) Field of Classification Search
CPC ..... A61G 7/035; A61G 7/053; A61G 7/0509; A61G 7/0516; A61G 7/0518; A47D 15/008; A47C 21/08
USPC ..... D6/382, 718, 718.3
See application file for complete search history.

(56) References Cited

U.S. PATENT DOCUMENTS

| | | | | |
|---|---|---|---|---|
| 5,400,450 | A | 3/1995 | Leoutsakos | |
| 5,787,530 | A | 8/1998 | Brix | |
| 6,240,583 | B1 | 6/2001 | Brooke et al. | |
| 6,539,569 | B2 | 4/2003 | O'Connell | |
| 6,557,188 | B1 | 5/2003 | Peterson | |
| 6,813,789 | B2 | 11/2004 | Leoutsakos | |
| 6,986,177 | B2 | 1/2006 | Thaxton | |
| 7,039,971 | B2 | 5/2006 | Sebastien | |
| 7,234,182 | B2 | 6/2007 | Miller et al. | |
| 7,373,679 | B2 * | 5/2008 | Miller | A47C 21/08 5/426 |
| 7,472,445 | B2 | 1/2009 | Miller | |
| D620,276 | S * | 7/2010 | Miller | D6/406.2 |
| 8,578,531 | B2 | 11/2013 | Abernathey et al. | |
| D702,073 | S * | 4/2014 | Miller | D6/718.3 |
| 8,973,192 | B2 * | 3/2015 | Miller | A47C 21/08 5/662 |
| 2004/0181877 | A1 * | 9/2004 | Miller | A47C 31/00 5/622 |
| 2005/0262632 | A1 * | 12/2005 | Wu | A47C 21/08 5/426 |

(Continued)

*Primary Examiner* — Robert G Santos
*Assistant Examiner* — Alison N Labarge
(74) *Attorney, Agent, or Firm* — Stoel Rives LLP

(57) ABSTRACT

A mobility assistance device including a base section and an upright section. The base section is configured to be disposed under a cushion-type portion of a piece of furniture. The base section includes a first base component and a second base component, each of the first and second base components including a first portion defining a base plane and a second portion extending generally upright in a plane perpendicular to the base plane. The upright section includes an arched component configured to couple the second portions of the two base components, and a height-adjustable handle coupled to the arched component.

21 Claims, 8 Drawing Sheets

(56) References Cited

U.S. PATENT DOCUMENTS

| | | | | |
|---|---|---|---|---|
| 2006/0101578 | A1* | 5/2006 | Shalikar | A47C 21/08 5/426 |
| 2007/0089242 | A1 | 4/2007 | Battiston | |
| 2011/0185507 | A1* | 8/2011 | Abernathey | A47C 31/00 5/662 |
| 2012/0117926 | A1 | 5/2012 | Miller | |

* cited by examiner

BED HANDLE SUPPORT SYSTEM

RELATED APPLICATION

This application claims priority to U.S. Provisional Application No. 62/416,529 filed Nov. 2, 2016, titled BED HANDLE SUPPORT SYSTEM, which is herein incorporated by reference in its entirety.

TECHNICAL FIELD

The present disclosure relates generally to mobility assistance devices. More specifically, the present disclosure relates to assistance devices, such as bed handle or rail devices, which may assist individuals in positioning themselves onto and securing themselves in beds or on similar furniture.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
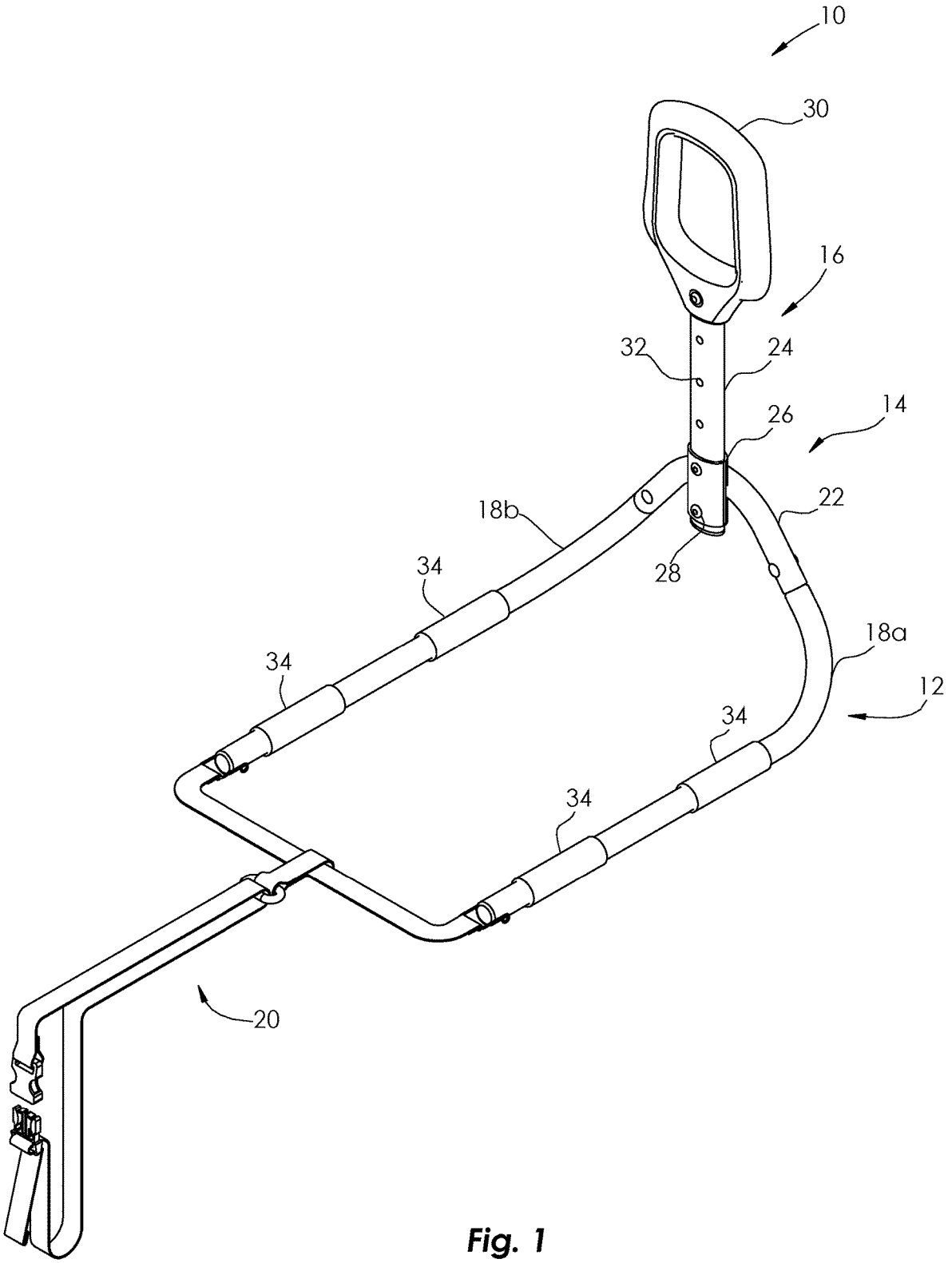
FIG. 1 illustrates a perspective view of a mobility assistance device in an operative configuration.

Bed handle or rail support systems and devices configurable in an operable configuration and a storage configuration are disclosed herein. It will be readily understood that the components of the embodiments as generally described below and illustrated in the figures herein could be arranged and designed in a wide variety of different configurations. Thus, the following more detailed description of various embodiments, as described below and represented in the figures, is not intended to limit the scope of the disclosure, but is merely representative of various embodiments. While the various aspects of the embodiments are presented in drawings, the drawings are not necessarily drawn to scale unless specifically indicated.

The phrases "operably connected to," "connected to," and "coupled to" refer to any form of interaction between two or more entities, including mechanical, electrical, magnetic, electromagnetic, fluid, and thermal interaction. Two entities may interact with each other even though they are not in direct contact with each other. For example, two entities may interact with each other through an intermediate entity, unless specified as directly interacting.

Mobility assistance devices may generally refer to pieces of medical equipment used to assist individuals with disabilities and/or other infirmities, including conditions incident to accidents, disease, age, or other causes. Mobility assistance devices may be designed to help individuals get into and out of reclining, sitting, and/or prone positions. For example, a mobility assistance device may be coupled to a bed or other piece of furniture designed for one to sit, lie down, or sleep upon. Furthermore, mobility assistance devices, such as bed rails, may also secure an individual in or on a piece of furniture, such as a bed, such that the individual is less likely to accidentally fall off the piece of furniture. Mobility assistance devices may be used in various environments, including in connection with a bed as a bed rail device.

In some instances, manufacturers of mobility assistance devices may desire to compactly package the devices for mass retail sale. Likewise, retailers may desire compact device storage to aid in optimizing profit per retail space, as products which are packaged in bulky containers, yet have a relatively small profit margin, may negatively impact profit per retail space.

Some mobility assistance devices are comprised of two sections: a base section and an upright section. The base section may form a plane configured to couple to a piece of furniture; for example, the base section may be configured to fit between a mattress or cushion and the support frame of a piece of furniture, such as between the mattress and box springs or foundation of a bed. The upright section may form a plane which is substantially perpendicular to the base, and may include a handle configured to be graspable by a user. Each of these sections may be sized so as to provide sufficient support for the intended function of the mobility assistance device. In some embodiments, each section may be quite large. Accordingly, mobility assistance devices may be packaged in substantially bulky containers, thus potentially resulting in a negative impact on the profit per retail space of mass retailers that carry mobility assistance devices.

In one aspect, the present disclosure provides a collapsible mobility assistance device and method of packaging which may allow for decreased package size. The mobility assistance device of the present disclosure may collapse down to a plurality of pieces sized such that they may be packaged in flat, planar packaging having a thickness as small as or approximates the thickness of a single piece. The upright section may break down into two or more pieces and the base may break down into two or more pieces, such that, when all the pieces are arranged in the storage (packaged) configuration, no piece is stacked upon any other piece. Thus, in some embodiments the package may only have the thickness of a single piece of the mobility assistance device.

The present disclosure may also optimize the number of parts into which the mobility assistance device separates. Optimization is not necessarily reducing the size of the pieces (which could result in a corresponding increase in the number of pieces) for the mobility assistance device to maintain desired operational dimensions. While the disclosure may optimize the number of pieces, it is not limited to breaking the product into more pieces to achieve a smaller packaged form. Optimization broadly means minimizing the number of pieces while simultaneously achieving a minimally sized package; this may be accomplished by making the pieces in similar sizes, in particular shapes, in certain embodiments.

Referring to FIG. 1, the mobility assistance device 10 depicted may be used in various environments, including with a bed as a bed rail device. In the illustrated embodiment, the collapsible mobility assistance device 10 comprises a base section 12 and an upright section 14. Attached to the upright section is a handle 16.

The base section 12 may be separated into two base components 18*a*, 18*b*. In some embodiments, a strap 20 may be provided that attaches two ends of the base components 18*a*, 18*b*. Base components 18*a*, 18*b* may be bent such that the base portions when unattached lay flat, but can be configured so that an end of each of the base components 18*a*, 18*b* is generally in an upright configuration when attached to the upright section 14 in an operative configuration.

In some embodiments, the base section 12 may be configured to couple device 10 to a piece of furniture. For example, it may be configured to be disposed under a cushion-type portion of a piece of furniture. The strap 20 may be used to attach the mobility assistance device 10 directly to the furniture. For example, if the mobility assistance device 10 is placed under a mattress, the strap 20 may be used to attach to the mobility assistance device 10 a bed frame the mattress is sitting on. The base components 18*a*, 18*b* may also include grip portions 34. The grip portions 34 limit the movement of the mobility assistance device when coupled to the piece of furniture. This helps prevent the mobility assistance 10 from moving relative to the furniture.

The upright section 14 includes a curved or arched component 22. Arched component 22 attaches the two ends of base components 18*a*, 18*b* so that the ends of the base components 18*a*, 18*b* extend generally in an upright position in a plane perpendicular to a base plane. The two ends of the base components 18*a*, 18*b* are inclined toward one another in that plane, such that the ends of the base components 18*a*, 18*b* attached to the arched component 22 are not parallel. The other end portions of the base components 18*a*, 18*b* are substantially parallel. That is, the space between the upright ends of the base components 18*a*, 18*b* may be smaller than the space between the other ends of the base components 18*a*, 18*b* connected to the strap 20. Furthermore, according to one embodiment the portion of the base components 18*a*, 18*b* that are substantially parallel (underneath a mattress or cushion) are not interconnected with a rigid cross member. In the embodiment shown in FIG. 1, the portion of the base components 18*a*, 18*b* that are substantially parallel are interconnected only by the strap 20. When unattached to the arched component 22, however, as mentioned above, each of the base components 18*a*, 18*b* can lay in a substantially flat manner in a storage configuration.

Attached to the upright section is an adjustable handle 16. The handle 16 may be adjusted in height. The handle 16 includes an elongate member 24 with a plurality of holes 32 provided along the elongate member 24. The elongate member 24 may attach to the arched component 22 via a bracket 26 and fasteners 28. Attached to the elongate member 24 is a handle portion 30 configured to be graspable by a user, which may be configured to support a user during movement. FIGS. 1 and 3-8 illustrate the handle 16 at the highest position. The upright portion 14 and handle 16 are sized such that elongate member 24 of the handle 16 does not drop below the plane of the base 12 when the elongate member 24 is in the shortest position.

In one embodiment, the elongate member 24 is a single post and is the only structure extending from the handle 16 toward the base section 12. Such a configuration can limit entrapment by a user who inadvertently rolls or falls off a bed.

The handle portion 30 contains multiple portions designed to be grasped or graspable by a user. In the embodiment depicted in FIG. 1, the handle portion 30 includes a top portion that has a central axis, which is generally parallel to the base plane (i.e., the plan formed by the portions of the base components 18*a*, 18*b* that are configured to be disposed underneath a mattress). The handle portion 30 also includes two graspable side portions extending downward from the top portion. In one embodiment, the graspable side portions each have a central axis that is generally perpendicular to the base plane. Also in one embodiment, the handle portion forms a rectangular shape to permit a user to grasp the handle portion 30 from the top, bottom or either side.

Figure 2:
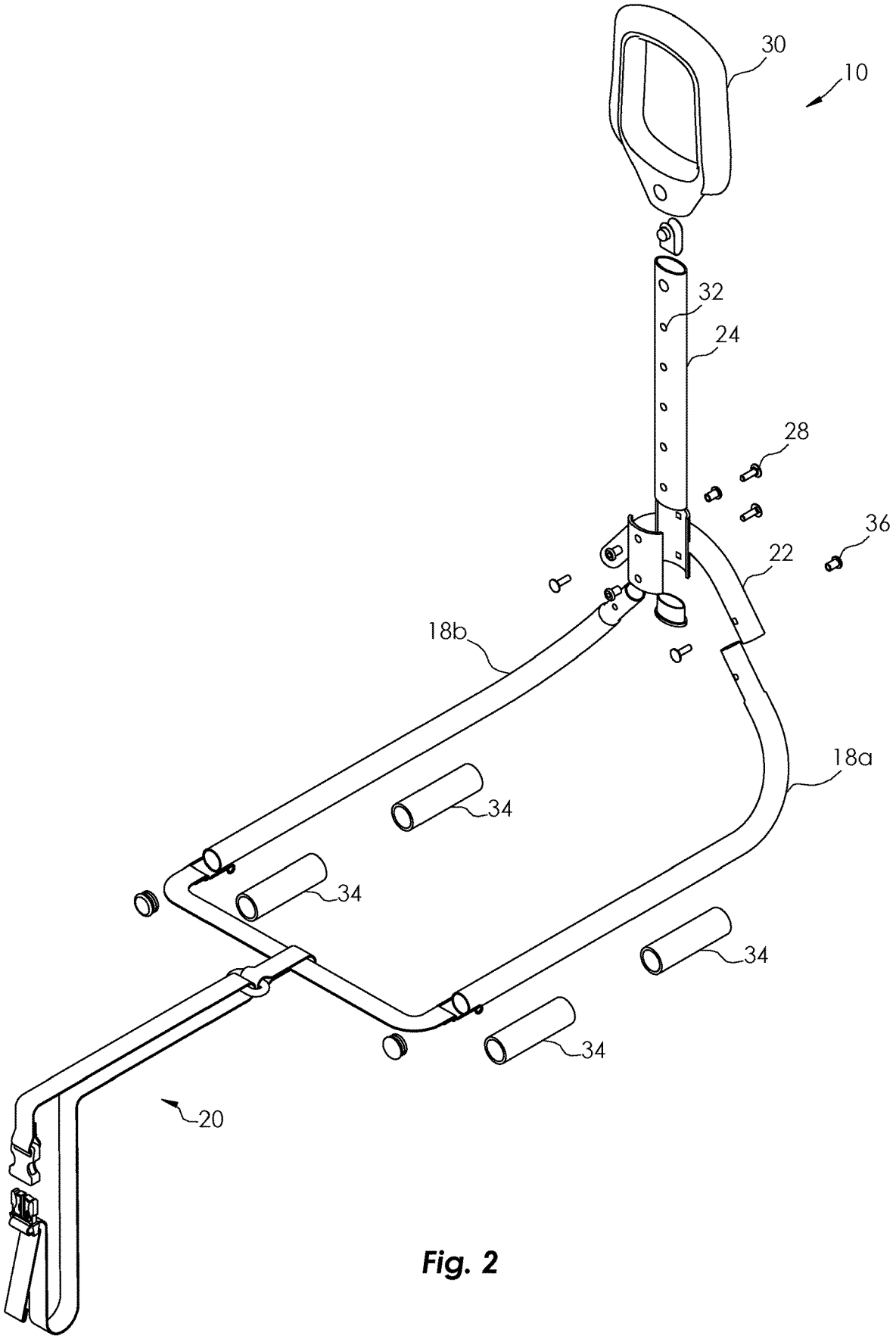
FIG. 2 illustrates an exploded perspective view of the embodiment of FIG. 1.
Figure 3:
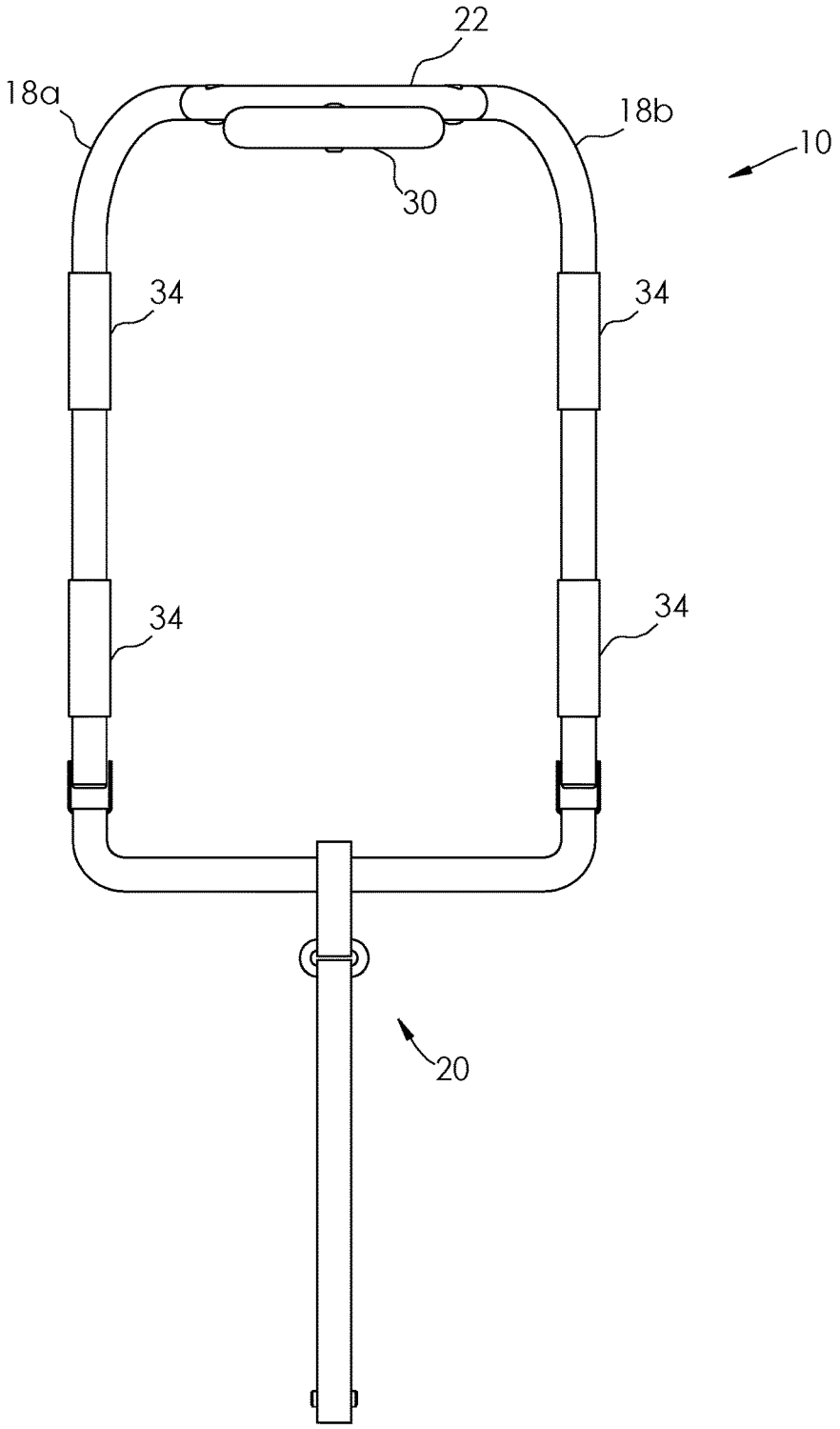
FIG. 3 illustrates a top view of the embodiment of FIG. 1.
Figure 4:
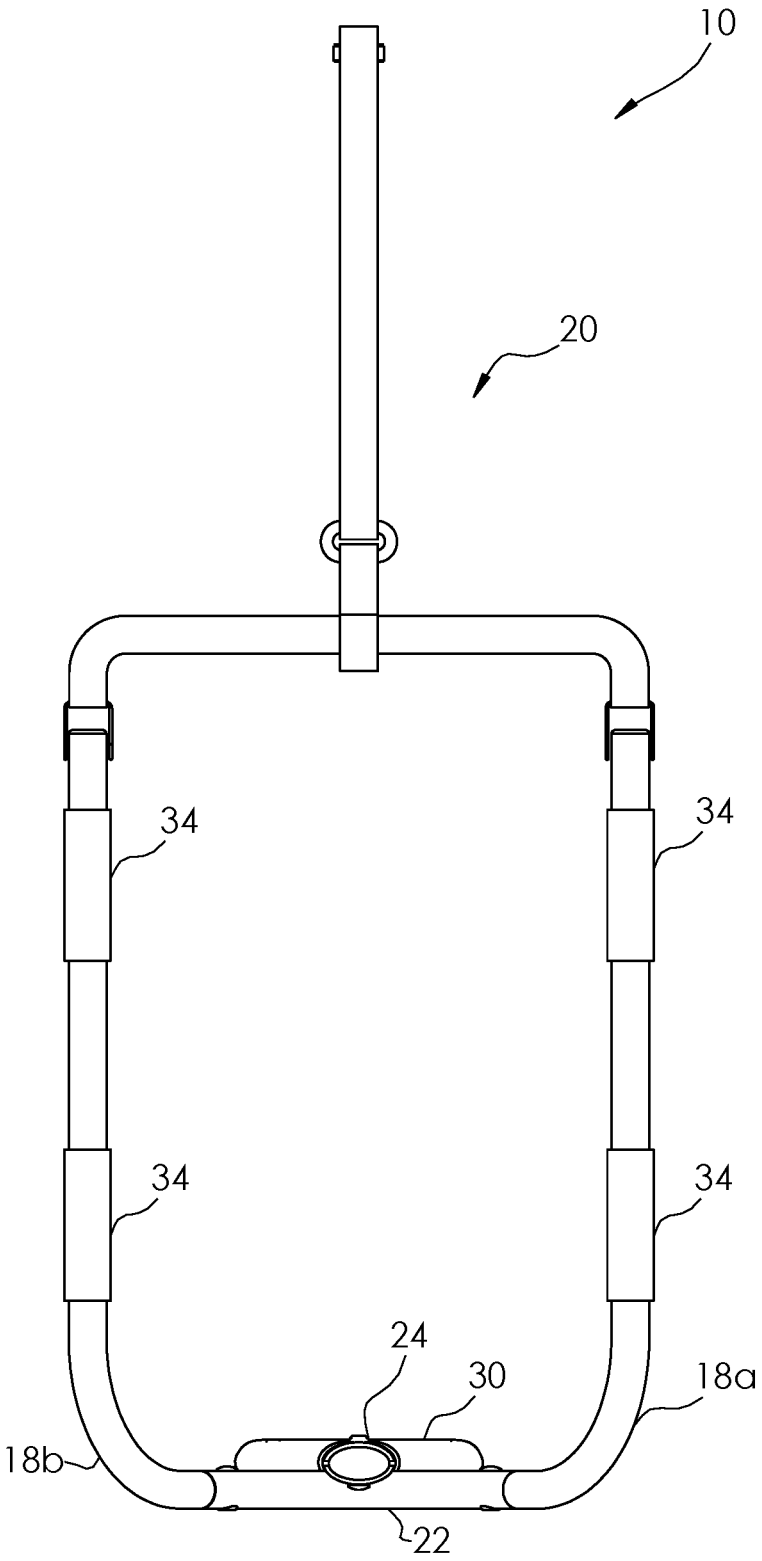
FIG. 4 illustrates a bottom view of the embodiment of FIG. 1.
Figure 5:
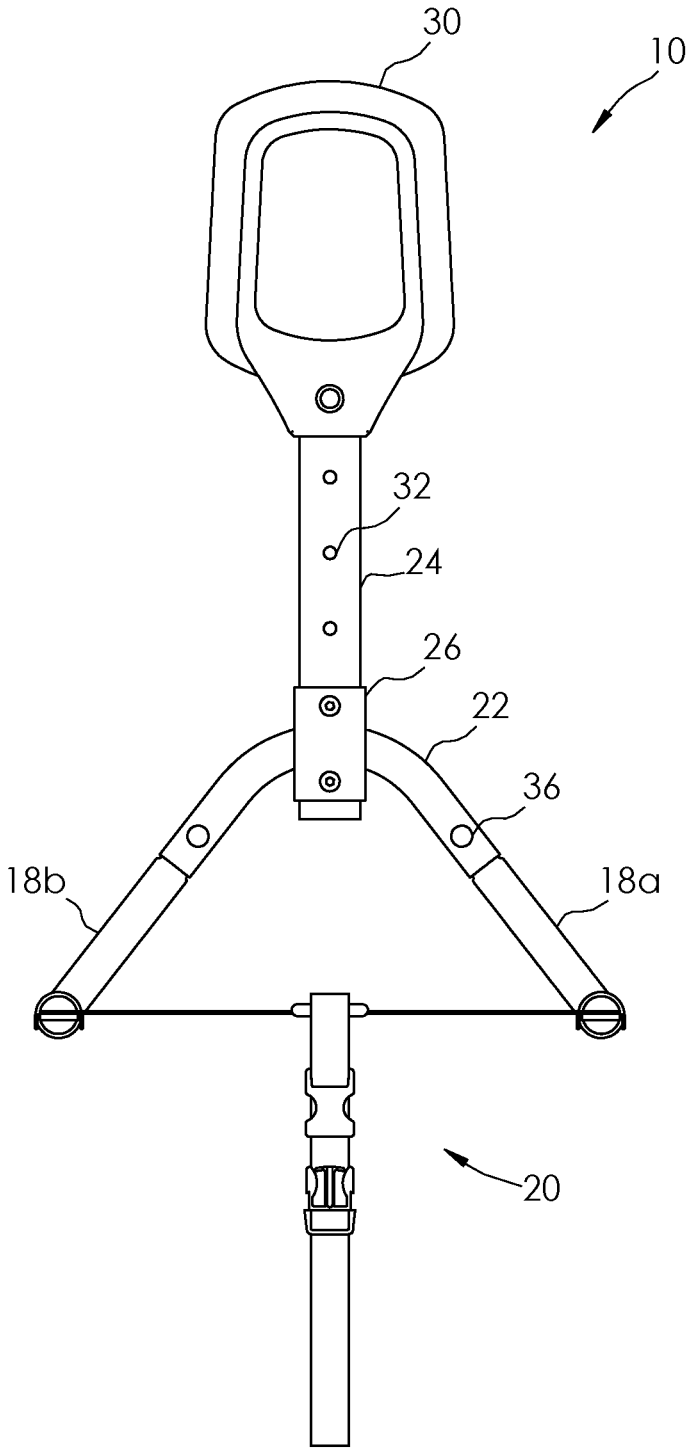
FIG. 5 illustrates a front view of the embodiment of FIG. 1.
Figure 6:
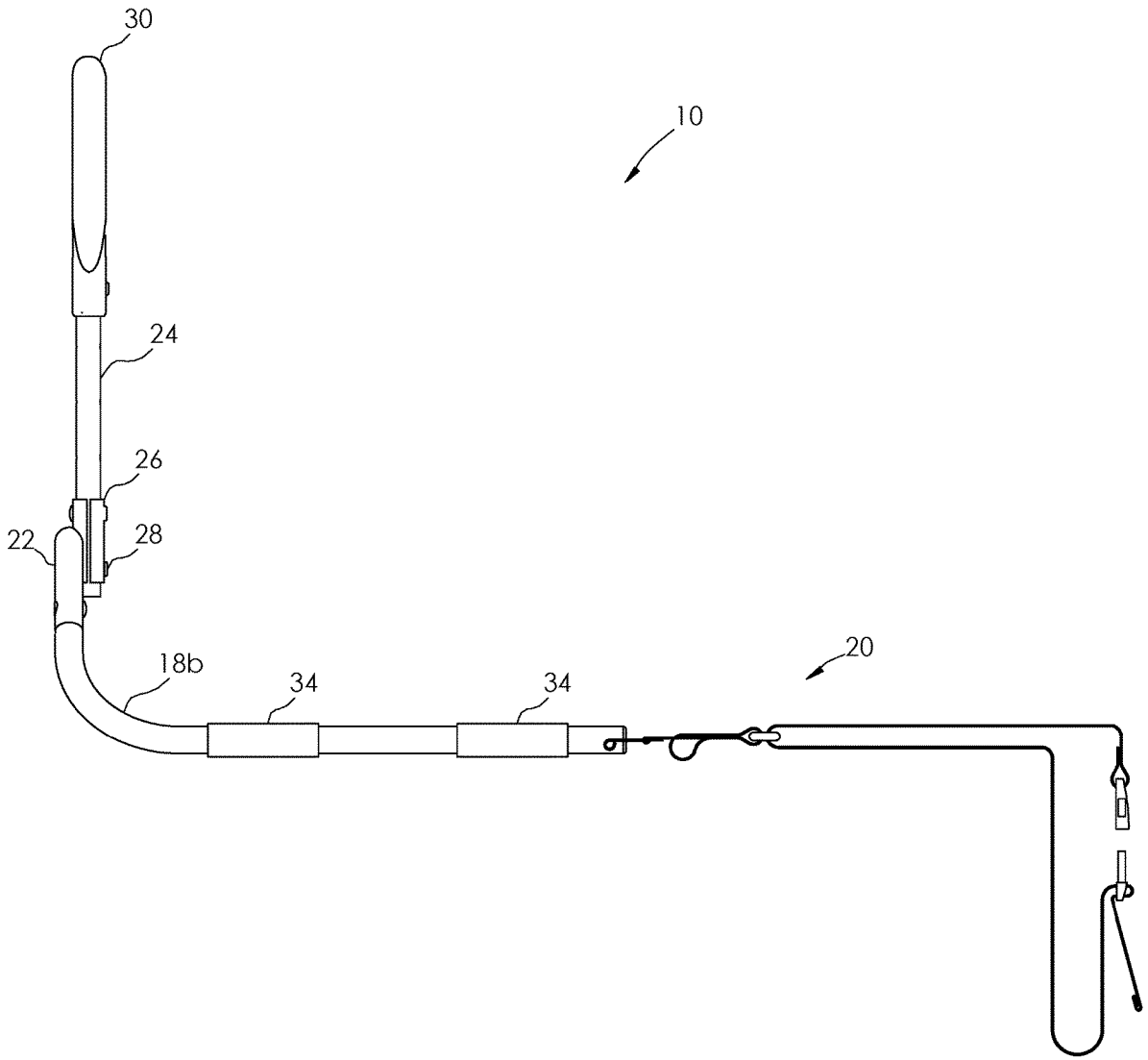
FIG. 6 illustrates a side view of the embodiment of FIG. 1.
Figure 7:
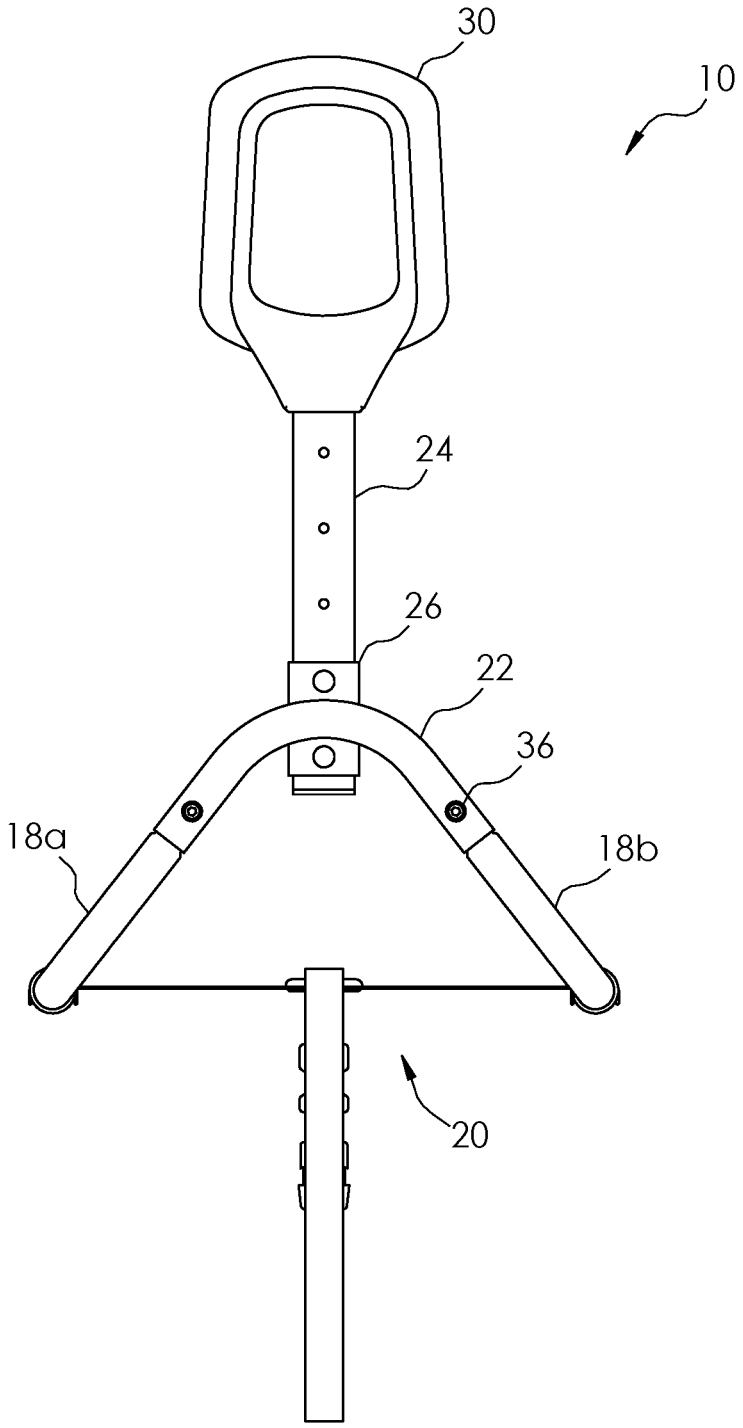
FIG. 7 illustrates a back view of the embodiment of FIG. 1.
Figure 8:
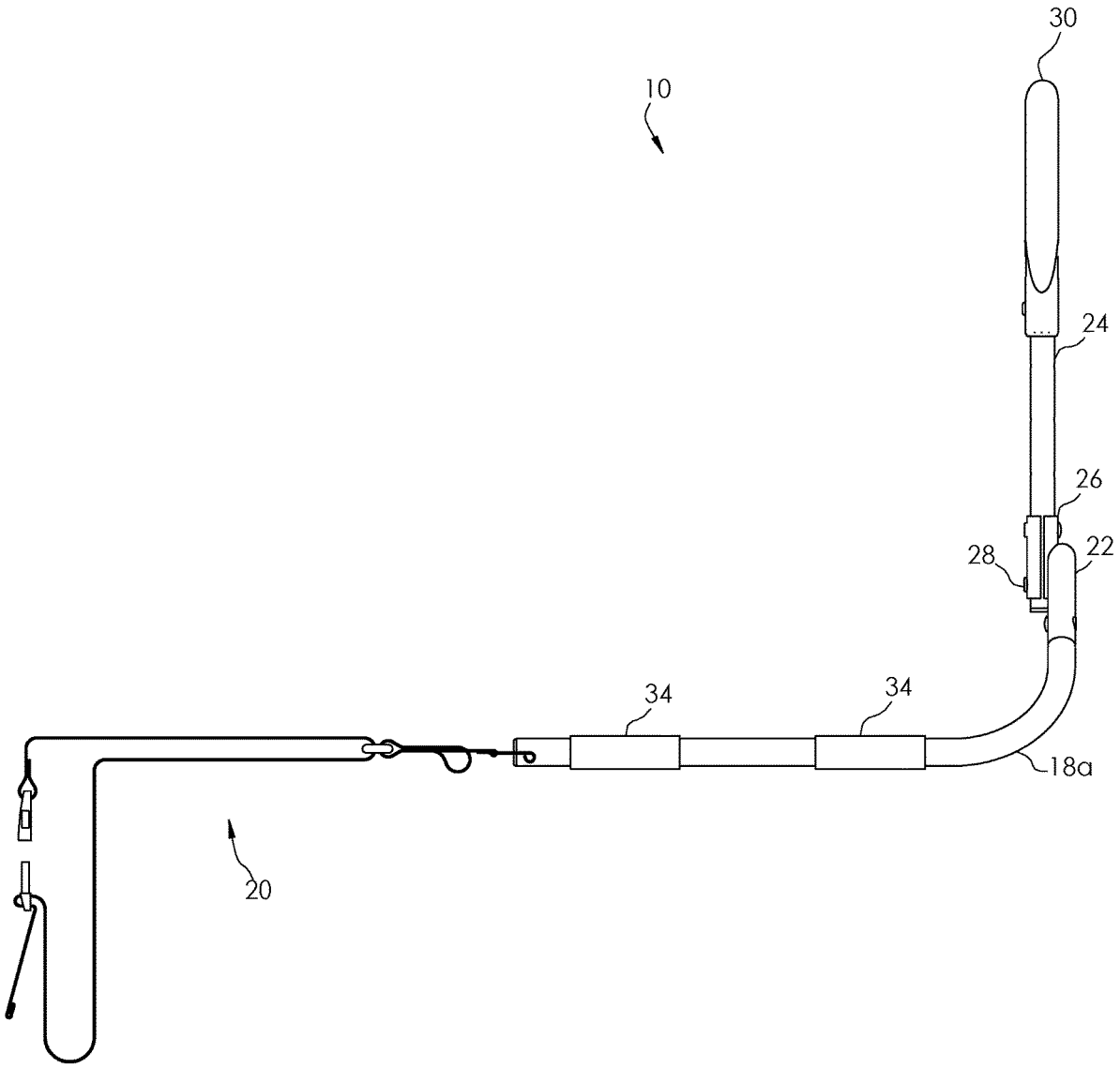
FIG. 8 illustrates another side view of the embodiment of FIG. 1.

FIGS. 1 and 3-8 illustrate mobility assistance device 10 in an operative configuration. The arched component 22 adjoins ends of the base components 18*a*, 18*b*, while the other ends of the base components 18*a*, 18*b* are each attached to an end of the strap 20. The ends of the base components 18*a*, 18*b* may be tapered and fit within the ends of the arched component 22. The arched component 22 and the base components 18*a*, 18*b* may further be coupled with fasteners 36. FIG. 2 illustrates each of these components decoupled from the others yet substantially oriented as they would be in an operative configuration.

Any of the portions or components of the mobility assistance device 10 (for example, components 18*a*, 18*b*, 22, 24, 26, and 30) may be coupled together through any method or means known in the art. For example, a person of ordinary skill in the art, having the benefit of this disclosure, will recognize that any suitable connector or connector means, including, but not limited to, a clip, a clamp, a detent, threads, a screw, a bracket, or any combination thereof may be used to couple the portions together.

Referring to FIG. 2, in some embodiments, the mobility assistance device 10 may be broken down into common-sized portions (or components), which may thereby optimize the size of the packaging in which the mobility assistance device 10 can be packaged, shipped, and/or stored.

In some embodiments, the components of the mobility assistance device 10 may be sized and designed such that they may be broken down and arranged in a substantially coplanar orientation. That is, the configuration, size and/or arrangements of the portions of the mobility assistance device 10 allow the mobility assistance device 10 to be packaged in a container having a thickness only large enough to accommodate a single layer of pieces. That is, in some embodiments, no piece is disposed on top of, or underneath, any other piece. Thus, a container, such as a box, sized to accommodate the collapsible mobility assistance.

In the embodiment shown in FIGS. 1-8, the base section 12 is separable into the two base components 18*a*, 18*b*, and the upright section 14 is separable into the arched component 22, the elongate member 24, and the handle portion 30. Other configurations and combinations are within the scope of this disclosure. For example, a base section may be separable into three pieces, and an upright section may be separable into three pieces. In other embodiments, the base section and the upright section may be separable into other combinations of pieces. In these and other embodiments, the pieces may have a substantially common size, which may allow for compact packaging in some instances. Specifically, in certain embodiments, the two base components 18*a*, 18*b* may be substantially the same size.

Furthermore, in the embodiment shown in FIGS. 1-8, each portion of the mobility assistance device 10 is formed such that each individual portion is planar. In other words, each portion of the device 10 is configured such that the longitudinal axis of the portion lies substantially in one plane. (As used in this sense, the longitudinal axis of a part refers to a collection of points along the center axis of the part, for example along the center of a substantially tubular part. This axis may not necessarily form a straight line, as the tubular parts may include bends, for example base portions such as 18*a*, 18*b*.) Thus, each portion is able to "lie flat" in a box or on a flat surface. It will be appreciated by those skilled in the art, having the benefit of this disclosure, that a wide variety of configurations (including, for example, altering the location of joints between the portions, the number of portions into which the device may be separated, and the location of junctions and/or elbows and other bends) may be designed such that each individual part is planar. In some embodiments, the device may be designed with all planar portions such that each portion can simultaneously be substantially disposed in a single plane, for example, when the device is disposed in a storage configuration. In such embodiments, a suitable storage container may only need a thickness configured to accommodate parts with a maximum thickness equal to the outside diameter of the tubular parts.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A mobility assistance device, comprising:

a base section configured to be disposed under a cushion-type portion of a piece of furniture, the base section comprising a first base component and a second base component, wherein each of the first and second base components comprising a first portion defining a base plane and a second portion extending generally upright in a plane perpendicular to the base plane; and an upright section, comprising:

a curved arch component with a substantially parabolic shape configured to couple the second portions of the two base components, and a height-adjustable handle component comprising a single elongate member and a handle portion attached to the elongate member, wherein a bottom portion of the elongate member does not extend below the base plane, wherein the single elongate member of the height-adjustable handle is coupled to a peak of the substantially parabolic shape of the curved arch component.

2. The mobility assistance device of claim 1, wherein the distance between the second portions of the base components is smaller than the distance between the first portions of the base components.

3. The mobility assistance device of claim 1, wherein the first portions of each of the base components are substantially parallel.

4. The mobility assistance device of claim 1, wherein the second portions of each of the base components are inclined toward each other in the plane perpendicular to the base plane.

5. The mobility assistance device of claim 1, wherein the height-adjustable handle component is coupled to the curved arch component such that a bottom portion of the height-adjustable handle component is positioned between the base plane and a top portion of the arched component.

6. The mobility assistance device of claim 1, wherein the upright section further comprises a bracket configured to couple the height-adjustable handle component to the curved arch component, wherein the elongate member comprises a plurality of holes and the bracket couples the height-adjustable handle component to the curved arch component via the plurality of holes.

7. The mobility assistance device of claim 1, wherein the first portion of the base components are not interconnected with a rigid cross member.

8. The mobility assistance device of claim 7, wherein the first portion of the base components are interconnected with a strap.

9. The mobility assistance device of claim 1, wherein the first base component and second base component are substantially equally sized in thickness.

10. The mobility assistance device of claim 1, wherein the handle portion comprises a top graspable portion and two side graspable portions extending downward from the top portion.

11. The mobility assistance device of claim 1, wherein the handle portion is coupled to the elongate member and the arched component, and wherein the single elongate member is the only structure extending from the handle toward the base section.

12. A collapsible mobility assistance device, having an operative configuration and a storage configuration, the collapsible mobility device comprising:

a base section configured to be disposed under a cushion-type portion of a piece of furniture when in the operative configuration, the base section comprising a first base component and a second base component, wherein each of the first and second base components comprise a first portion defining a base plane and a second portion extending generally upright in a plane perpendicular to the base plane; and an upright section, comprising:

a curved arched component with a substantially parabolic shape configured to couple the second portions of the two base components when in the operative configuration, and a height-adjustable handle component comprising a single elongate member and a handle portion coupled to the elongate member and the arched component, wherein the single elongate member is the only structure extending from the handle toward the base section, and wherein a bottom portion of the elongate member does not extend below the base plane when in the operative configuration;

wherein the base section and upright section are each substantially planar when in the storage configuration, wherein the first base component, the second base component, the arched component and the height-adjustable handle component are configured to be oriented in a substantially coplanar orientation when the device is in the storage configuration, and wherein the single elongate member of the height-adjustable handle is coupled to a vertex of the substantially parabolic shape of the curved arch component.

13. The mobility assistance device of claim 12, wherein in the operable configuration, a distance between the second portions of the base components is smaller than a distance between the first portions of the base components.

14. The mobility assistance device of claim 12, wherein the first portions of each of the base components are substantially parallel.

15. The mobility assistance device of claim 12, wherein the second portions of each of the base components are inclined toward each other in the plane perpendicular to the base plane.

16. The mobility assistance device of claim 12, wherein the handle portion comprises a top graspable portion and two side graspable portions extending downward from the top portion.

17. The mobility assistance device of claim 12, the upright section further comprises a bracket to couple the height-adjustable handle component to the arched component, wherein the elongate member comprises a plurality of holes and the bracket couples the height-adjustable handle component to the arched component via the plurality of holes.

18. The mobility assistance device of claim 12, wherein the first portion of the base components are interconnected with a strap.

19. The mobility assistance device of claim 12, wherein the first base component and second base component are substantially equally sized in thickness.

20. The mobility assistance device of claim 12, wherein when the device is in the storage configuration, the first and second base components, the arched component, and the adjustable handle are configured such that they are stored in a flat, planar container having a maximum thickness substantially equal to the thickness of the thickest component.

21. A mobility assistance device, comprising:

a base section configured to be disposed under a cushion-type portion of a piece of furniture, the base section comprising a first base component and a second base component, wherein each of the first and second base components comprising a first portion defining a base plane and a second portion extending generally upright in a plane perpendicular to the base plane; and an upright section, comprising:

a curved arched component with a parabolic shape configured to couple the second portions of the two base components, and a height-adjustable handle component comprising a single elongate member and a handle portion attached to the elongate member, wherein a bottom portion of the elongate member does not extend below the base plane, wherein the first portion of the base components are not interconnected with a rigid cross member and the first portion of the base components are interconnected with the strap, and wherein the single elongate member of the height-adjustable handle is coupled to a peak of the parabolic shape of the curved arch component.

* * * * *